United States Patent [19]

Larson

[11] 4,388,898

[45] Jun. 21, 1983

[54] OIL CONTAINMENT DEVICE

[75] Inventor: Wally M. Larson, Evansville, Ind.

[73] Assignees: Ronald Luttrell; Gerald Edson, both of Terre Haute, Ind.

[21] Appl. No.: 268,570

[22] Filed: May 29, 1981

[51] Int. Cl.[3] ..... F01M 11/00

[52] U.S. Cl. ..... 123/90.38; 123/198 E; 184/13 R

[58] Field of Search ..... 123/90.38, 198 E; 184/13 R

[56] References Cited

U.S. PATENT DOCUMENTS

| | | | |
|---|---|---|---|
| 3,430,612 | 3/1969 | Ansteth | 123/90.38 |
| 3,568,799 | 3/1971 | Bivins | 123/90.38 |
| 3,821,942 | 7/1974 | Ishida et al. | 123/90.38 |

FOREIGN PATENT DOCUMENTS

| | | | |
|---|---|---|---|
| 2737901 | 3/1979 | Fed. Rep. of Germany | 123/90.38 |

*Primary Examiner*—William A. Cuchlinski, Jr.
*Attorney, Agent, or Firm*—Zarley, McKee, Thomte, Voorhees & Sease

[57] ABSTRACT

An Oil Containment Device for Valve Adjustment is disclosed. The device provides a valvetrain oil containment dam and cover. The dam is bolted to an engine head in lieu of a conventional valve cover. The dam contains engine oil; thus, allowing the adjustment of engine valve tolerances while the engine is operating. A separate valve cover is provided which is removably attached to the oil containment dam to exclude contaminants during normal operation of the engine other than when the valve tolerances are being adjusted.

4 Claims, 4 Drawing Figures

OIL CONTAINMENT DEVICE

BACKGROUND OF THE INVENTION

1. Field of the Invention

This invention relates to oil containment devices which allow for valve adjustment while engines are operating, and in particular such devices attached to engines having rocker arm valvetrain assemblies.

2. Background of the Invention

Conventional engine heads having rocker arm valve assemblies provide lubrication by forcing oil around the moving parts of the valvetrain assembly. In order not to lose the oil and to keep contaminants out of the engine, it has long been known that the valvetrain assemblies can be covered with a valve cover. The cover normally attaches to the head by a number of bolts and a gasket and can be removed in order to allow the valve tolerances to be adjusted.

Although many manufacturers of automobile and truck engines suggest that the valve tolerances be adjusted while the engine is cold, it has been found that for precise adjustment and fine tuning, it is necessary in many engines to adjust the valve tolerances while the engine parts are warm and operating.

In order to adjust the valve tolerances while the engine is operating, the conventional method was to remove the conventional valve cover and replace the oil that was lost while the valve adjustment was undertaken. In addition to the loss of engine oil, it has been found that the engine oil which escapes while the valve adjustment is underway tends to coat portions of the engine, making it very difficult to keep the engine and work area clean. The engine oil lost is not only a nuisance, but also attracts dirt which contributes to an unsightly appearance as well as improper engine operating temperatures.

Other than setting the valve tolerances while the engine is not running, little has been done to remedy the situation.

In high performance engines such as racing engines and the like, it has been found that constant valve adjustment requires constant removal of the valve cover along with the attendant loss of spilled oil and the necessity for constantly replacing valve cover gaskets to maintain the proper oil seal while the engine is operating.

Accordingly, a need exists for an oil containment device which will allow an easy access to the valvetrain for valve adjustment while at the same time containing the oil which is splattered in the operation of the engine. The instant invention is directed toward that need.

SUMMARY OF THE INVENTION

The invention provides an oil containment device which replaces a conventional valve cover in engines which allow for the adjustment of valve tolerances while the engine is operating. The invention provides an oil containment dam which attaches at the conventional valve cover attachment point and provides an additional valve cover which removably attaches to the oil containment dam. The additional valve cover is provided with an oil gasket that allows for easy removal of the cover. The oil containment dam is attached to the conventional valve cover attachment points and the engine head with conventional sealing methods.

An additional object of the invention is to provide an oil containment device for valve adjustment which is adaptable to engine heads of all descriptions including straight blocks, V-blocks and L-blocks.

An additional object of the invention is to provide an oil containment device which allows for valve adjustment while the engine is operating.

A still further object of the invention is to provide an oil containment device which allows for valve adjustment while the engine is operating and is easily adaptable to existing engines and fits within existing engine compartments. A still further object of the invention is to provide an oil containment device for valve adjustment of the engines which allow for quick and easy access of valve adjustments.

Still other objects and features of the invention will be apparent from the following description in which the preferred embodiments are set forth in detail in conjunction with the accompanying drawings.

DESCRIPTION OF THE PREFERRED EMBODIMENTS

Figure 1:
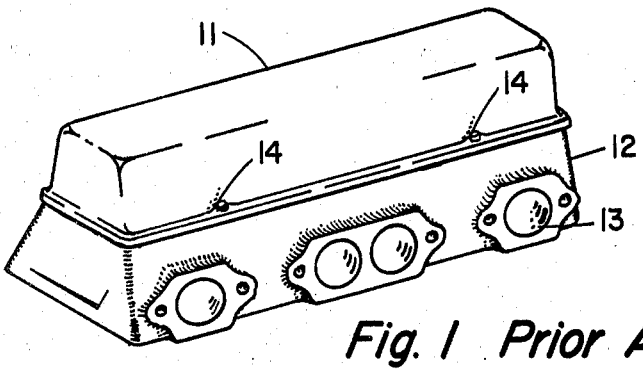
Fig. 1 Prior Art
FIG. 1 is a perspective view of a prior art conventional valve cover attached to an engine head.

As illustrated in the drawings, the invention replaces the prior art conventional valve cover 11 as shown in FIG. 1. In FIG. 1 it can be seen where engine block 12 is provided with valve ports 13 and valve cover attachment bolts 14. Prior art conventional valve cover 11 simply attaches to engine head 12 by means of a gasket not shown in order to seal the oil while the engine is operating.

Figure 2:
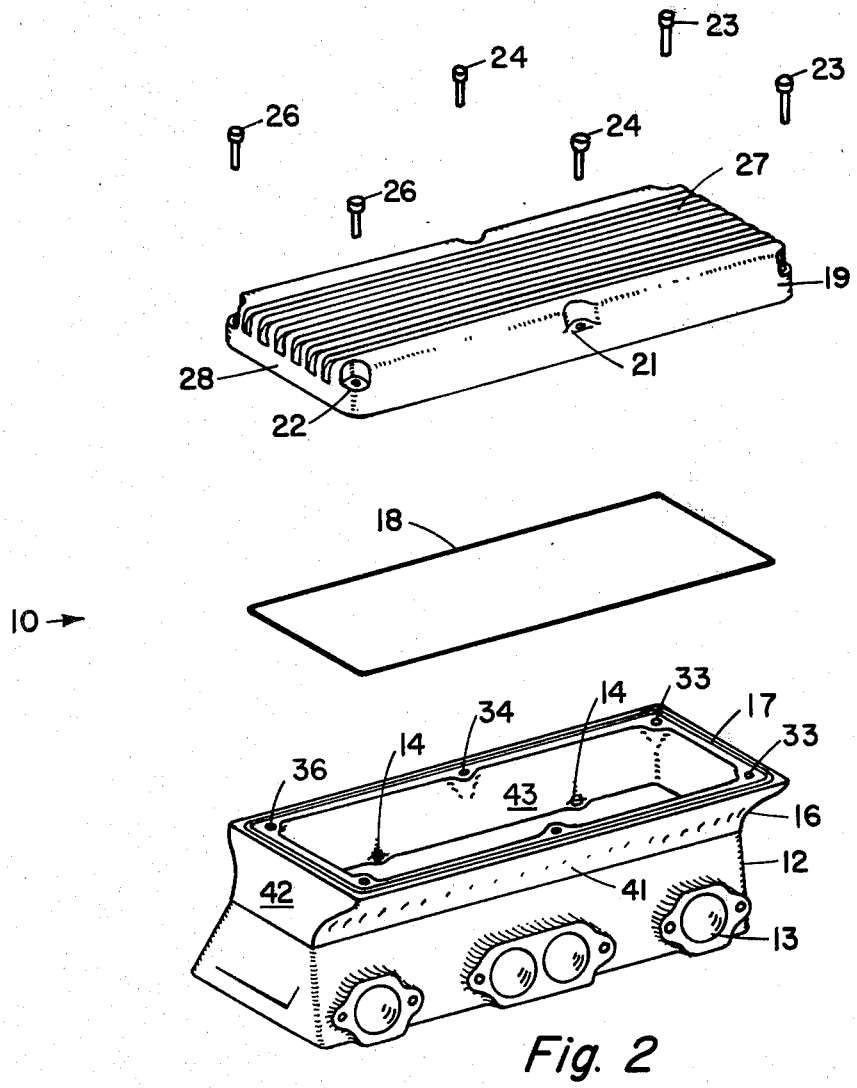
FIG. 2 is a exploded perspective view of one embodiment of the oil containment device according to the invention wherein the invention is attached to a conventional engine head.

In FIG. 2, the invention is shown and it can be seen that oil containment dam 16 is generally a four-walled open structure having generally upstanding end walls 42, a generally upright wall 43 and a generally sloping wall 41. Dam 16 is further provided with attachment holes 14 which co-act with engine head 12. Upper rim 17 of dam 16 is provided with cover attachment holes 33, 34 and 36 as well as oil sealing groove 17 which is a trough allowing for O-ring 18 to be placed in alignment with trough 17.

Figure 3:
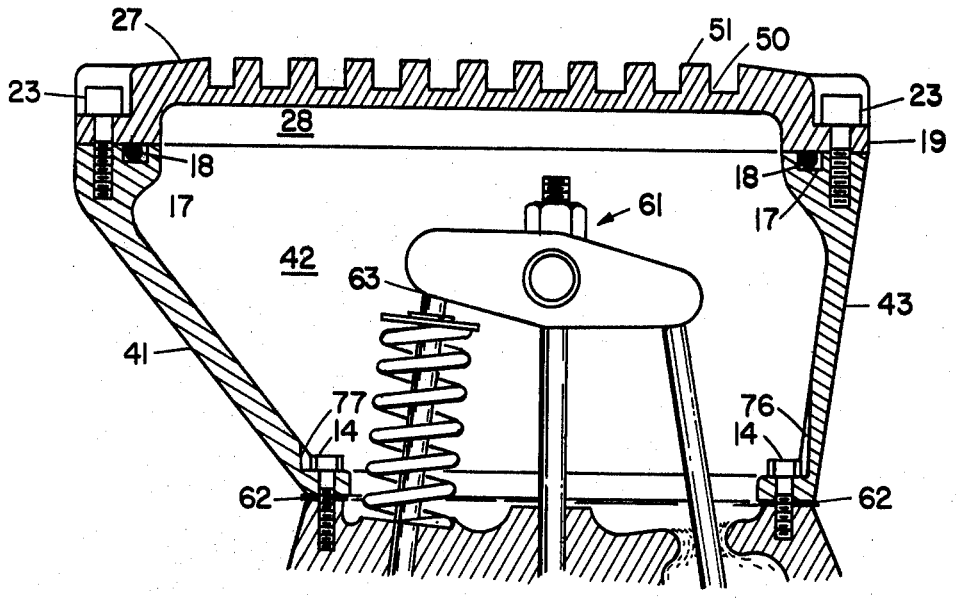
FIG. 3 is a cutaway end view showing the invention in place on an engine head having a conventional valve rocker arm push rod assembly.

In FIG. 3, it can be seen where O-ring 18 co-acts with trough 17 and cover 27 to seal oil and contaminants from the valvetrain area when the cover is attached.

Referring back to FIG. 2, cover 27 is a fitted structure provided with upstanding end walls 28, sidewalls 19 and cover portion 27. Corners 22 are provided with holes as are side recesses 21. The holes at 22 and 21 allow bolts 23, 24 and 26 to attach cover 27 to oil containment dam 16 at bolt hole 33, 34 and 36.

Referring now to FIG. 3, it can be seen that conventional head 12 is fitted with oil containment dam 17 by use of bolts 14 which are on the inside of oil containment dam as contrasted with the outside of oil cover 11 as shown in prior art conventional valve cover. Since oil containment dam 17 is generally not removed once installed, it is not necessary to provide exterior bolts. By not having such exterior bolts, it improves the appearance of the engine and allows less space for grease, dirt and other contaminants to gather. Oil containment dam 17 is provided with conventional gasket 62 or other oil sealant which makes the connection between oil containment dam 17 and engine block 12 more oil tight than conventional prior art valve covers which are constantly being removed for valve adjustment.

Referring to FIG. 3, it can be seen that cover 27 is attached to oil containment dam 17 by removable bolts 23 and cover 27 pushes down on O-ring 18; thus, providing a sealant between the underside of 28 of cover 27. Grooves 50 and lands 51 are provided in cover 27 for asthetic purposes as well as to aid in cooling. Valvetrain 61 is provided with a space for adjustment 63. Oil containment dam 17 is provided with bolt bosses 76 and 77 in upstanding walls 43 and 41 which reinforce walls 43 and 41 and allow for turning of bolt 14.

Figure 4:
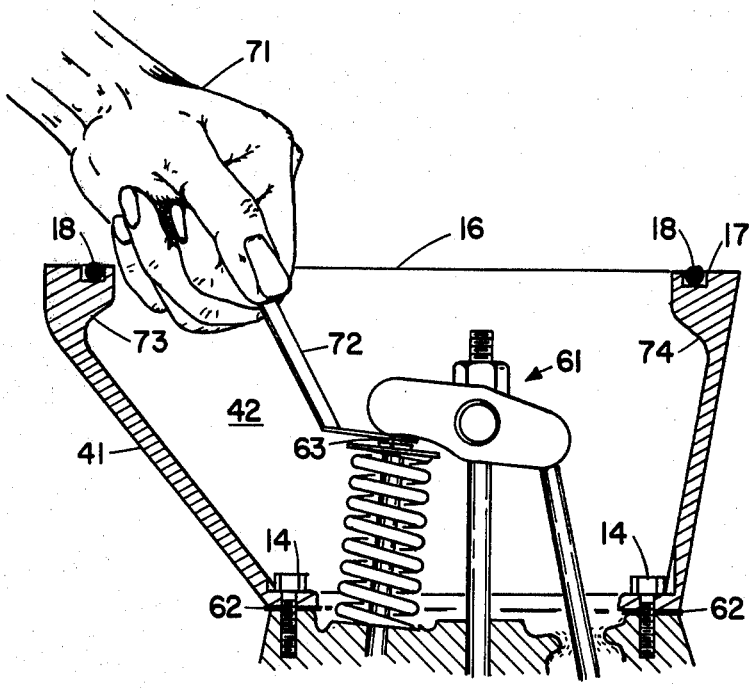
FIG. 4 is a cutaway end view of the invention in place on a conventional head wherein the cover of the invention is removed and a mechanic's hand is shown adjusting valve tolerances.

Referring now to FIG. 4, it can be seen that mechanic 71 has removed cover 27 and has inserted a feeler gauge 72 to adjust valve tolerance 63. Oil which has splattered from valvetrain 61 would splash against walls 43, 42 and 41 and run back into engine block 12. Sloping wall 41 in oil containment dam 12 provides extra space for mechanic 71 to adjust the valve tolerances. Nevertheless, it must be understood that the sloping of walls 41 and 43 can be arranged as necessary given a different engine to which the oil containment device is attached. Different engines are provided with different accessories and differing amounts of space in the engine compartment.

As can be shown in FIG. 4, walls 43 and 41 are also provided with reinforced thickening areas 73 and 74 for additional strength as well as to provide a groove 17 for oil sealing O-ring 18. Oil sealing ring 18 extends above rim 16 until compressed by cover 27 as shown in FIG. 3. Oil sealing O-ring 18 could be replaced with a conventional cork gasket; however, it has been found that the rubber O-ring provides a much better sealing means when the cover 27 is removed constantly as is the case with racing engines which must have the valves adjusted constantly in order to maintain a fine state of tune.

It is apparent from the foregoing that a new and improved oil containment device for valve adjustment has been provided. While only certain presently preferred embodiments have been described in detail, as will be apparent to those familiar with the art, certain changes and modifications can be made without departing from the scope of the invention as defined by the following claims.

I claim:

1. An oil containment device for preventing loss of oil during valve adjustment of an internal combustion engine having rocker arm valve train assemblies and attachment means for securing a valve cover thereover, comprising, an oil containment dam comprising a peripheral wall structure having upper and lower edges and including upstanding opposite end walls and upstanding side walls extended between said end walls, means for attaching said peripheral wall structure to an engine with the valve cover attachment means thereof, means for sealing the lower edge of the peripheral wall structure to the engine to prevent oil leakage therebetween, said peripheral wall structure having a height such that the upper edge thereof is positioned above said valve train assembly upon attachment of the peripheral wall structure to the engine, a cover being of a size and shape to cover and close the opening defined by the upper edge of the peripheral wall structure, and means for removably securing and sealing said cover onto said peripheral wall structure, said peripheral wall structure being free of projections which extend interiorly over said valve train assemblies whereby said valve train assemblies are freely accessible without interference by such projections.

2. The oil containment device of claim 1 wherein said cover is generally flat.

3. The oil containment device of claim 2 wherein said cover is provided with a plurality of cooling grooves.

4. A method of modifying an internal combustion engine to prevent loss of oil during valve adjustment with the engine operating, said engine including rocker arm valve train assemblies, at least one generally inverted trough-shaped valve cover and attachment means for securing said valve cover to the engine over said valve train assemblies, said method comprising, providing an oil containment dam comprising a peripheral wall structure having upper and lower edges, removing said valve cover from the engine, substituting said oil containment dam for said valve cover including sealing the lower edge of the peripheral wall structure to the engine and securing said peripheral wall structure to the engine with said valve cover attachment means, said peripheral wall structure extending upwardly at least slightly above said valve train assemblies, and removably securing and sealing a cover onto the upper edge of said peripheral wall structure whereby, upon removal of said cover, said peripheral wall structure is operative to confine and contain oil directed onto the valve train assemblies during operation of the engine so that the valve train assemblies may be adjusted without loss of oil.

* * * * *